US009922760B1

(12) United States Patent
Kite

(10) Patent No.: US 9,922,760 B1
(45) Date of Patent: Mar. 20, 2018

(54) SELECTIVELY INSULATED ELECTROMAGNET AND ELECTROMAGNET COIL ASSEMBLY

(71) Applicant: Nathaniel Martin Kite, Sanford, NC (US)

(72) Inventor: Nathaniel Martin Kite, Sanford, NC (US)

( * ) Notice: Subject to any disclaimer, the term of this patent is extended or adjusted under 35 U.S.C. 154(b) by 0 days.

(21) Appl. No.: 15/357,365

(22) Filed: Nov. 21, 2016

(51) Int. Cl.
*H01F 5/06* (2006.01)
*H01F 7/20* (2006.01)

(52) U.S. Cl.
CPC ..... *H01F 7/20* (2013.01); *H01F 5/06* (2013.01)

(58) Field of Classification Search
CPC ..... H01F 5/06; H01F 7/20
See application file for complete search history.

(56) References Cited

U.S. PATENT DOCUMENTS

| | | | | |
|---|---|---|---|---|
| 2,771,386 | A * | 11/1956 | Merz | H01B 3/448 174/110 R |
| 3,187,235 | A | 6/1965 | Berlincourt et al. | |
| 3,710,000 | A | 1/1973 | Shattes et al. | |
| 3,956,724 | A | 5/1976 | Fagan, Jr. | |
| 4,538,131 | A | 8/1985 | Baier et al. | |
| 5,365,211 | A | 11/1994 | Carbaugh, Jr. et al. | |
| 6,274,240 | B1 * | 8/2001 | McBane | H01F 41/068 174/120 SR |
| 8,653,925 | B2 | 2/2014 | Schmidt | |
| 2016/0086707 | A1 | 3/2016 | Hahn et al. | |

* cited by examiner

*Primary Examiner* — Ramon M Barrera
(74) *Attorney, Agent, or Firm* — Olive & Olive, P.A.

(57) ABSTRACT

An electromagnet includes a magnetically susceptible pole piece. A wire is wound around the pole piece about an axis of the pole piece. The wire is selectively coated with insulating material at different sections thereof and wound in a manner where no section of wire having no insulating material coated thereon contacts another section of wire having no insulating material coated thereon. In one aspect there is a flat wire having four surfaces. In another aspect, the wire is circular or elliptical shape wire which is selectively insulated in a manner described.

6 Claims, 7 Drawing Sheets

SELECTIVELY INSULATED ELECTROMAGNET AND ELECTROMAGNET COIL ASSEMBLY

BACKGROUND OF THE INVENTION

1. Field of the Invention

This invention relates to electromagnets, and more specifically to electromagnet coil assemblies which reduce the amount of insulation required to be used in electromagnets.

2. Discussion of Prior Art

Electromagnets can be used to convert mechanical energy into electrical energy or vice versa. They are found in a number of different types of devices such as solenoids to provide linear motion; electric motors to provide rotary motion; and generators which convert motion to electricity.

The basic principle of operation of an electromagnet is that an electric current applied to a conductor, usually a wire, will create a magnetic field. This is illustrated in FIG. 1, in which a current runs through a conductor 11 to generate a magnetic field 13. When a wire 15 is wrapped into a coil as illustrated in FIG. 2, the wire 15 having a current running therethrough generates more magnetic field lines 17.

As yet further illustrated in FIG. 3, a material of high magnetic permeability may be inserted as a core pole piece 23 of an electromagnet so that a wire 21 is wrapped into a coil around the core pole piece 23 around an axis thereof. The core pole piece 23 is typically made of soft iron and can increase the output of the electromagnet by more than a hundred fold. In addition, the more wire turns an electromagnet has, the more powerful the magnet will be. Power also increases if the coil is more compact.

Early electromagnets used uninsulated wire. This created a problem because the lack of insulation could cause a short in the wire and reduce the overall power output. For example, if one turn touched another turn, they would act as a single turn thus decreasing the power. As a result, wire insulation was developed for the manufacture of what is often called "magnet wire" which allows the wire to touch multiple layers of turns without shorting. Typically, magnet wire is insulated with a thin enamel layer coating the wire. Other electrical wire insulators which can be used include rubber, paper and air. Insulation has some disadvantages however because it results in a magnet being considerably more expensive to manufacture than bare conductor such as copper wire. Moreover, the insulation creates additional distance between the wire and the magnetic core or pole thereby reducing power output.

In accordance with the invention the problems of having large amounts of insulation are avoided through the use of a wire which is selectively insulated, and then wound in a predetermined manner to avoid shorting.

BRIEF SUMMARY OF THE INVENTION

In one aspect, the invention relates to an electromagnet which includes a magnetically susceptible core or pole piece. A flat wire is wrapped around the pole piece about the axis of the pole piece. The flat wire has four outer surfaces with two surfaces of the four surfaces being coated with an insulating material, and the other two outer surfaces having no insulating material coated thereon. The flat wire is wound around a pole piece in a manner ensuring an outer surface with insulating material on it is always in contact with an outer surface having no insulating material coated on it, and wherein no surface having no insulating material coated on it contacts another surface having no insulating material coated on it.

In yet another aspect, the invention relates to an electromagnet which includes a magnetically susceptible core or pole piece. A magnet wire is selectively coated with insulating material at first predetermined sections, and left uncoated with insulating material at second predetermined sections. The magnet wire is then wound around a pole piece about its axis in a manner where no sections of the magnet wire that are not coated with insulating material are in contact with any other sections of wire that are not coated with insulating material.

In yet still another aspect, the invention relates to an electromagnet which includes a magnetically susceptible core or pole piece. A generally circular wire includes first selected sections thereof completely coated with insulating material, and second selected sections only coated with insulating material on one half of the wire's outer surface. The wire is wound around the pole piece about its axis in a manner wherein each section of the wire which is not coated with insulating material is always in contact with a section of wire coated with insulating material, and no section of wire which is not coated with insulating material is in contact with another section which is not coated with insulating material. In more specific aspects, the pole pieces are made of iron. Yet still more specifically, the insulating material is a thin enamel coating.

BRIEF DESCRIPTION OF THE DRAWINGS

Having thus briefly described the invention, the same will become better understood from the appended drawings viewed with reference to the detailed description, in which.

DETAILED DESCRIPTION OF THE PREFERRED EMBODIMENTS

Figure 1:
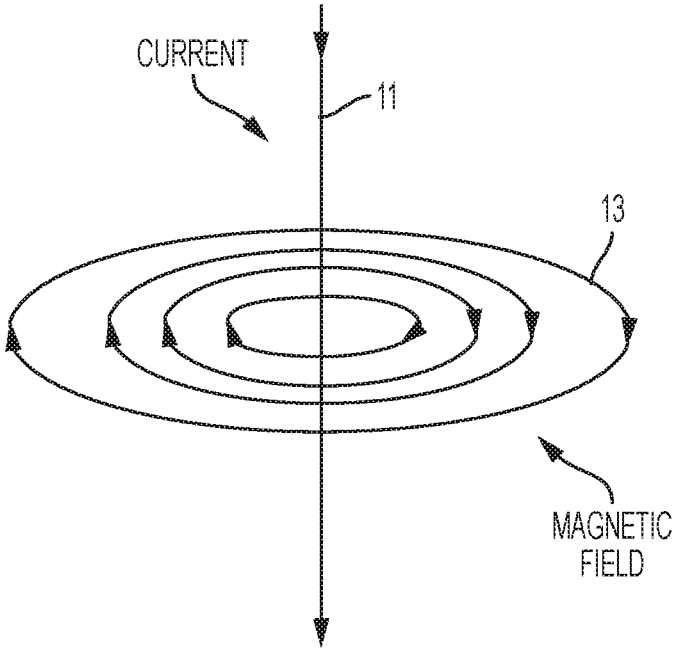
FIG. 1 PRIOR ART
FIG. 1 is prior art illustration showing how a current through an electric wire generates a magnetic field.
Figure 2:
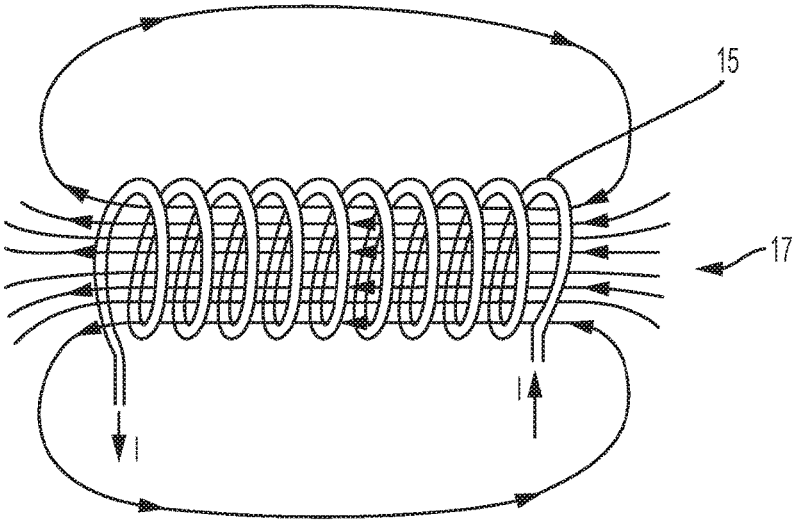
FIG. 2 PRIOR ART
FIG. 2 is a prior art illustration of how winding an electrical conductor into a coil increases the magnetic field generated when electricity is passed through the coil.
Figure 3:
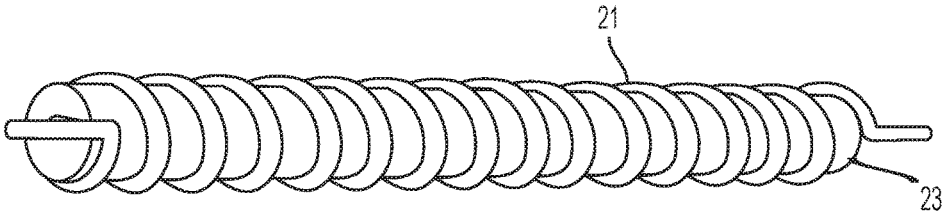
FIG. 3 PRIOR ART
FIG. 3 is a prior art schematic view of a typical electromagnet having a pole piece with a conducting wire wound around the pole piece along a length of its axis.
Figure 4:
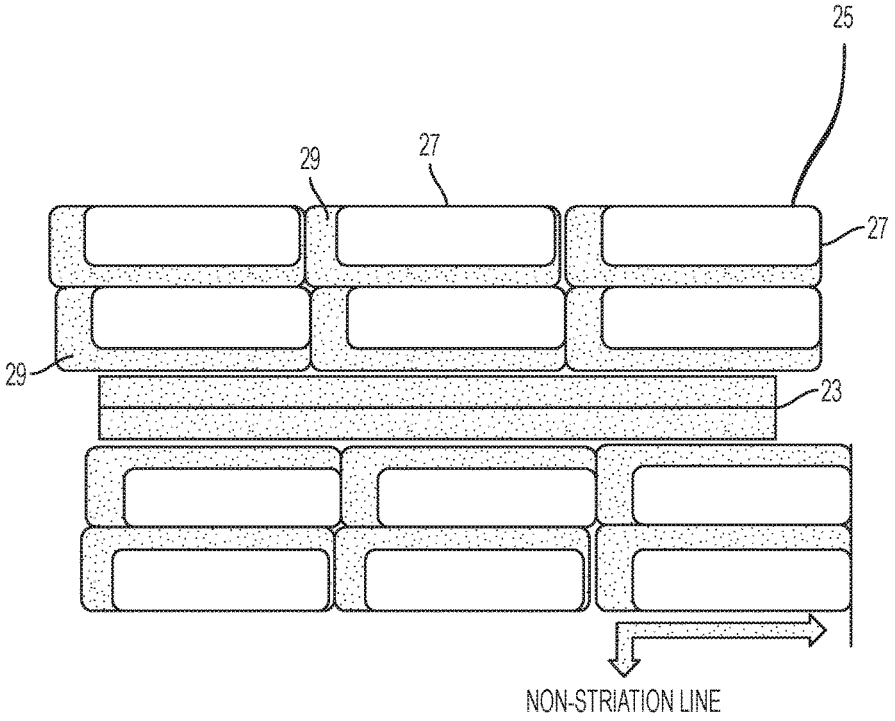
FIG. 4 is a partial view of an electromagnet showing one embodiment of the invention with a flat wire conductor selectively insulated in accordance with the invention and wound around a pole piece.

In FIG. 4 an electromagnet includes a flat wire conductor 25 which is wound around a pole piece 23 about or along the axis of the pole piece. The flat wire conductor 25 is selectively insulated by coating two surfaces 29. The two surfaces 29 in this embodiment are adjacent each other, and are coated with an insulating material, typically a ceramic. The other two surfaces 27 are left uncoated, and have no insulating material coated thereon, or a minimal amount of isolative coating thereon depending on the method of manufacture. The flat wire conductor 25 is then wound in a manner where at no point does an uncoated surface 27 contact another uncoated surface 27, thereby ensuring no shorts will occur when current is being applied to the flat wire conductor 25. In this manner, significantly less insulation is used, resulting in less cost and improved performance of the electromagnet due to the fact that the spacing's between turns of the flat wire conductor 25 are somewhat reduced due to the lack of insulation on the uncoated surfaces 27 which have no insulating material thereon.

As will be appreciated the two coated surfaces need not be adjacent each other and any other configurations will suffice so long as the wire can be wound into an arrangement where no uncoated surface contacts another uncoated surface.

Figure 5:
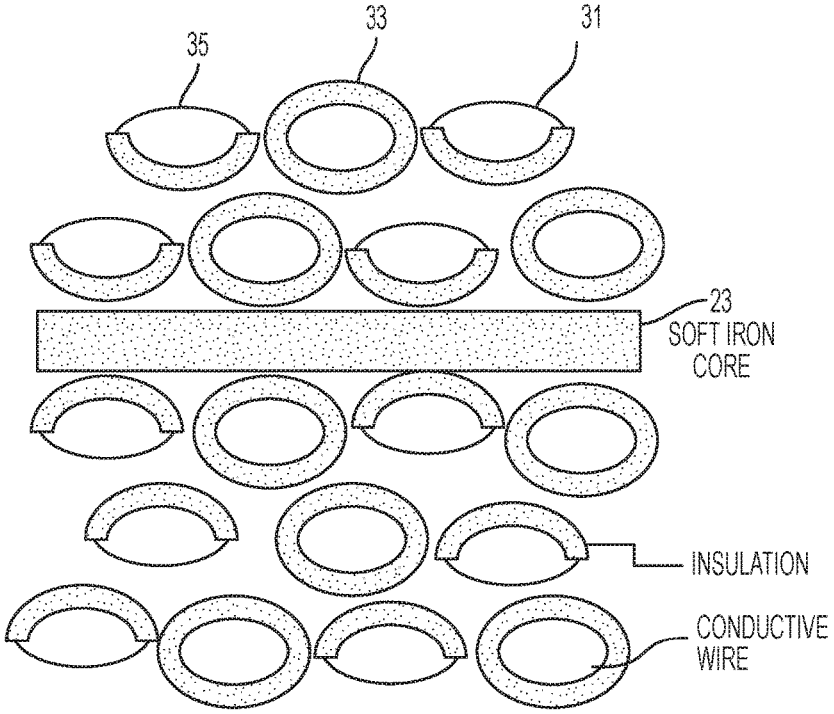
FIG. 5 is a view of an alternative selectively insulated electromagnet conductor arrangement using generally rounded or elliptical wire which is selectively insulated to prevent shorting and is wound around a pole piece.

FIG. 5 illustrates a second embodiment of the invention in which elliptical, oval or round wire 31 is wound around a pole piece 23 about an axis of the pole piece. In this embodiment sections 33 of the round wire 31 are completely coated with insulating material and other sections 35 of the round wire 31 are only half coated with insulating material, as is illustrated. While more insulating material is used in this embodiment than in the flat wire embodiment of FIG. 4, the amount of insulating material used is still reduced, and providing a winding arrangement as shown in FIG. 5, results in no uncoated section of round wire 31 contacting another uncoated section of round wire 31, thereby avoiding shorting.

In terms of materials selected for the electromagnet, they are conventional and well known to those of ordinary skill in the art. Preferably the core or pole piece has a high permeability. The pole piece, for example, is of a material having a relative permeability $\mu_r$ of about 1 or greater. One typical material for the pole piece 23 is iron. The insulation may be enamel which can be deposited as thin as possible without losing its isolative properties. The wire itself can be made of copper, aluminum, or any other kind of highly conducted material to result in a powerful electromagnet.

Figure 6:
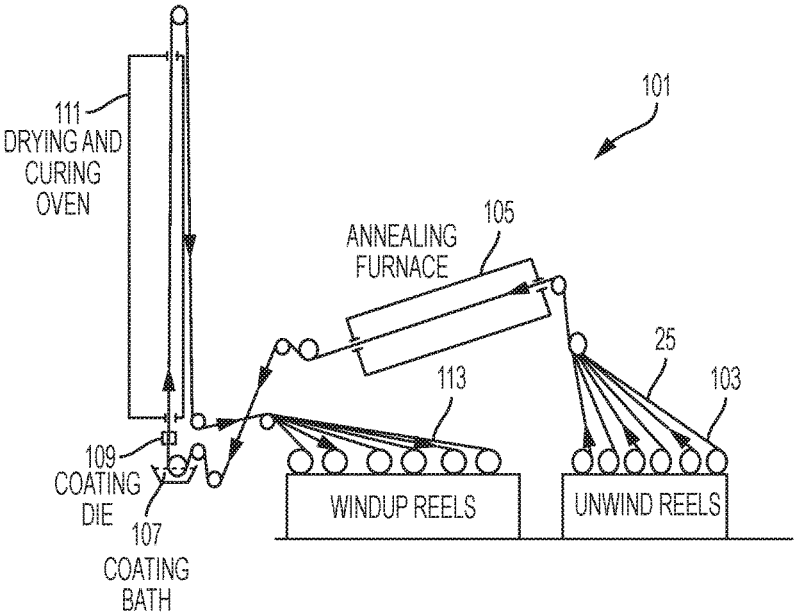
FIG. 6 is a side view of a conventional wire coating device modified with respect to its coating die for coating wire with insulative material.

FIG. 6 illustrates a typical coating and drying machine 101 for applying coating in accordance with the invention. In this regard, reference is made to http://www3.epa.gov/ttnchie1/ap42/ch04/final/c4s02_2c.pdf, the disclosure of which is specifically incorporated in its entirety by reference herein.

In the machine 101 of FIG. 6, reels 103 of flat wire to be coated are unwound and a flat wire 201 (FIG. 7) passes through an annealing furnace 105. From the annealing furnace 105, the flat wire 25 is passed through a coating bath 107 wherein it is coated with an insulative coating in liquid form. The flat wire 25 is then passed in contact with coating die 109 to have insulation selectively removed as described with reference to FIG. 7.

Once the insulation is selectively removed, the selectively coated flat wire 25 is passed through a heating and curing oven 111 and rewound on windup spools 113.

Figure 7:
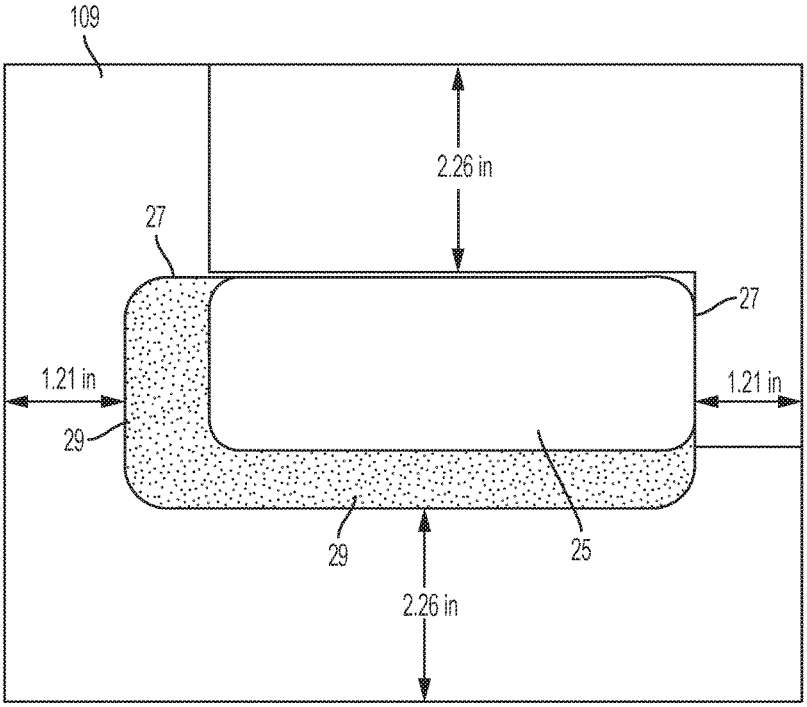
FIG. 7 is a front view of a casting die and a flat wire as it is being coated by a machine such as that of FIG. 6 to achieve selective partial coating of the flat wire.

As further shown in FIG. 7 the flat wire 25 comes into contact with coating die 109 which is shaped to remove insulation from selected surfaces of flat wire 25 while providing a spaced section (not numbered) which allows the insulative layers 29 to remain on the flat wire 25 while scraping off insulation to result in substantially not coated surface 27.

It is noted that this invention applies to conventional electromagnets and not other types such as superconducting electromagnets where the problems attendant insulation used are much different and differently addressed than with magnets of the invention.

Having thus described the invention the same will become better understood from the appended claims in which it is described in a non-limiting manner.

What is claimed is:

1. An electromagnet comprising:

a magnetically susceptible pole piece;

a flat wire wound around the pole piece about an axis of the pole piece;

said flat wire having four outer surfaces with two surfaces of the outer surfaces adjacent each other coated with an insulating material, and the other two outer surfaces having no insulating material coated thereon; and said flat wire being wound around the pole piece in a manner wherein an outer surface with insulating material coating is in contact with an outer surface having no insulating material coating on it, and wherein no outer surface having no insulating material coated thereon contacts another outer surface having no insulating material coated thereon.

2. The electromagnet of claim 1, wherein said pole piece is made of material having a relative permeability $\mu_r$ of about 1 or greater.

3. The electromagnet of claim 1, wherein pole piece is made of iron.

4. The electromagnet of claim 1, wherein the insulating material is a thin enamel.

5. The electromagnet of claim 1, wherein the flat wire is made of copper.

6. The electromagnet of claim 1, wherein the flat wire is made of aluminum.

* * * * *